US008113319B2

(12) United States Patent
Anttila et al.

(10) Patent No.: US 8,113,319 B2
(45) Date of Patent: Feb. 14, 2012

(54) ELEVATOR AND SYSTEM AND METHOD FOR LOCKING AN ELEVATOR CAR IN PLACE

(75) Inventors: Aripekka Anttila, Järvenpää (FI); Esko Aulanko, Kerava (FI); Håkan Bärneman, Solna (SE); Osmo Björni, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 236 days.

(21) Appl. No.: 11/437,626

(22) Filed: May 22, 2006

(65) Prior Publication Data

US 2006/0266589 A1 Nov. 30, 2006

Related U.S. Application Data

(63) Continuation of application No. PCT/FI2004/000181, filed on Mar. 29, 2004.

(30) Foreign Application Priority Data

Nov. 24, 2003 (FI) ..... 20031720

(51) Int. Cl.
*B66B 5/16* (2006.01)
*B66B 11/08* (2006.01)
*B66B 5/04* (2006.01)

(52) U.S. Cl. ..... 187/379; 187/264; 187/266; 187/375; 187/377

(58) Field of Classification Search ..... 187/377, 187/378, 379, 352, 367, 370–372
See application file for complete search history.

(56) References Cited

U.S. PATENT DOCUMENTS

| | | | | | |
|---|---|---|---|---|---|
| 604,360 | A | * | 5/1898 | Bell | 187/306 |
| 621,475 | A | * | 3/1899 | McCormick | 187/379 |
| 1,360,653 | A | | 11/1920 | Liddicoat | |
| 1,382,211 | A | * | 6/1921 | Miller | 187/371 |
| 1,443,823 | A | * | 1/1923 | Miller | 187/379 |
| 2,897,920 | A | | 8/1959 | falter et al. | |
| 4,502,570 | A | * | 3/1985 | Westerlund | 187/264 |
| 4,650,036 | A | * | 3/1987 | Matsuda | 187/239 |
| 5,370,208 | A | * | 12/1994 | De Jong | 187/372 |
| 5,411,117 | A | * | 5/1995 | Hayrinen | 187/360 |
| 5,788,018 | A | * | 8/1998 | Mendelsohn et al. | 187/404 |
| 6,193,017 | B1 | * | 2/2001 | Koster | 187/258 |

(Continued)

FOREIGN PATENT DOCUMENTS

DE 1251926 * 4/1965

(Continued)

*Primary Examiner* — Michael Mansen
*Assistant Examiner* — Stefan Kruer
(74) *Attorney, Agent, or Firm* — Harness, Dickey & Pierce, P.L.C.

(57) ABSTRACT

An elevator may include an elevator car, one or more hoisting ropes, a traction sheave, an overspeed governor, at least one safety gear, a locking mechanism, and guide rails. The car may be suspended by the one or more hoisting ropes. The traction sheave may move the car using the one or more hoisting ropes. The at least one safety gear and locking mechanism may be fitted in conjunction with the car. The overspeed governor may be configured to activate and release, via a linkage, the at least one safety gear during operation of the elevator. The locking mechanism may be configured to activate and release, by operatively acting on the linkage, the at least one safety gear during installation, maintenance, or installation and maintenance of the elevator. When activated, the at least one safety gear may engage one of the guide rails to lock the car in place.

17 Claims, 3 Drawing Sheets

U.S. PATENT DOCUMENTS

Figure 1:
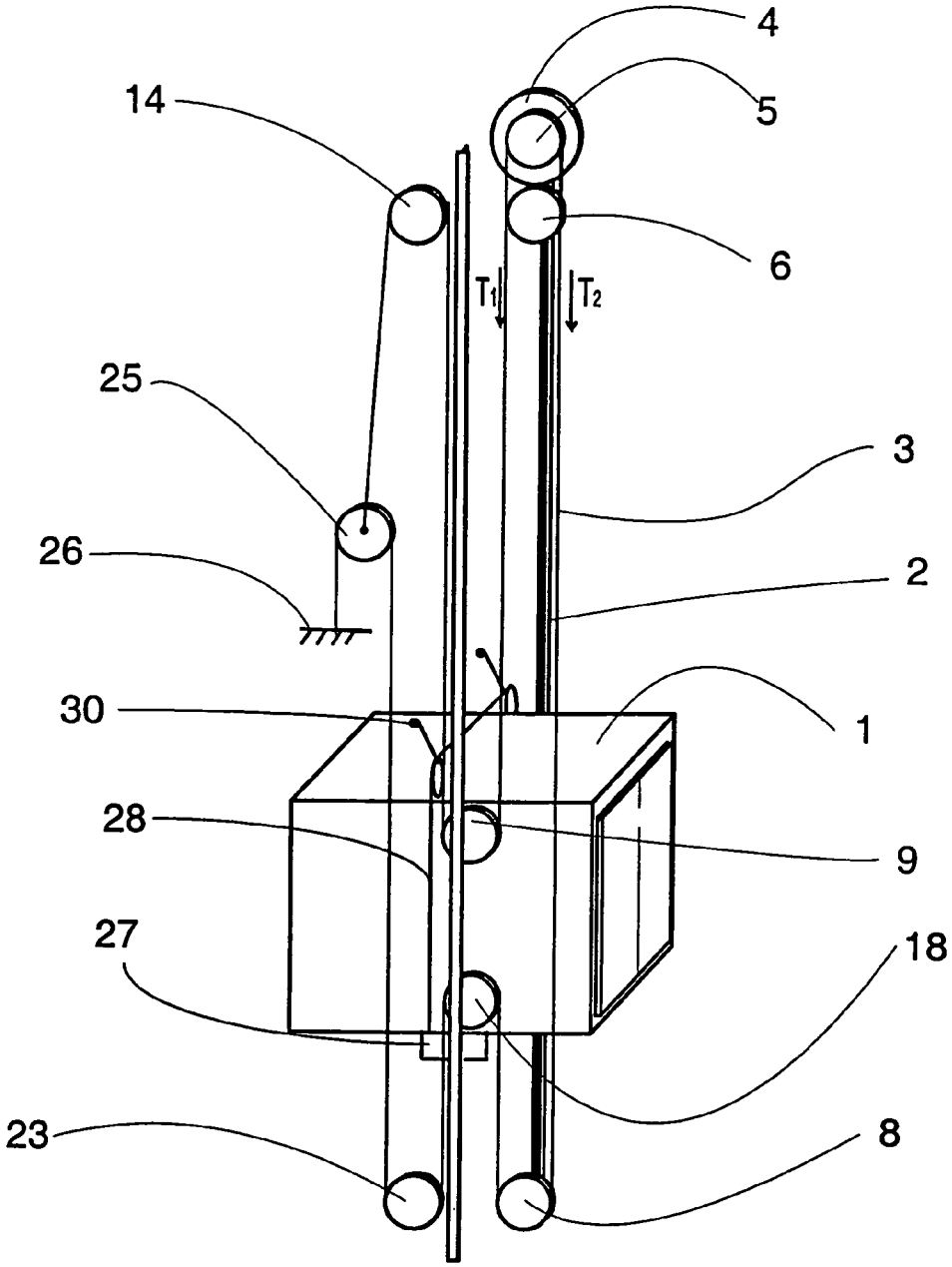

| | | | | |
|---|---|---|---|---|
| 6,357,556 | B1 * | 3/2002 | Pettersson et al. | 187/414 |
| 6,374,953 | B1 * | 4/2002 | Casas | 187/399 |
| 2003/0183457 | A1 * | 10/2003 | Maury et al. | 187/250 |

FOREIGN PATENT DOCUMENTS

| | | | | |
|---|---|---|---|---|
| EP | 613851 | A1 | * | 9/1994 |
| EP | 1323660 | A | | 7/2003 |
| FR | 2823734 | A1 | * | 10/2002 |
| GB | 1442584 | A | | 7/1976 |
| GB | 1 539 602 | | | 1/1979 |
| JP | 04246079 | A | * | 9/1992 |
| JP | 06255949 | A | * | 9/1994 |
| JP | 8295468 | A | | 11/1996 |
| JP | 9002750 | | | 1/1997 |
| JP | 9295773 | | | 11/1997 |
| WO | WO 03055780 | A1 | * | 7/2003 |

* cited by examiner

ELEVATOR AND SYSTEM AND METHOD FOR LOCKING AN ELEVATOR CAR IN PLACE

PRIORITY STATEMENT

This application is a continuation of PCT/FI2004/000181, filed on Mar. 29, 2004, which is an international application of Finnish Patent Application No. 20031720, filed on Nov. 24, 2003, the disclosure of which is incorporated herein by reference in its entirety.

SUMMARY

The present invention relates to an elevator, a system for locking an elevator car in place, and a method for locking an elevator car in place.

According to prior art, an elevator car can be locked in place by means of a separate locking device. In a prior-art solution, the elevator car is locked in place by means of a bolt, the elevator car being provided with an apparatus for pushing the bolt into a hole in a guide rail so as to lock the elevator car in place. Another prior-art solution is disclosed in specification U.S. Pat. No. 4,333,549, which describes a blocking apparatus for blocking an elevator car in place. The specification discloses a separate blocking apparatus by means of which the elevator car is blocked manually in place by using a separate blocking device. In this solution, the elevator car must always be blocked manually separately at each desired position and the aforesaid blocking device must always be locked and released manually by means of a tightening bolt. In these solutions, the problem is a slow and complicated arrangement for blocking the elevator car in place. Another problem is that the solutions proposed are not very well applicable for use e.g. in elevator solutions without counterweight.

The object of the present invention is to overcome the above-mentioned drawbacks and to achieve an easy and simple locking apparatus for locking an elevator car in place. The invention aims at achieving at least one of the following objectives. On the one hand, the invention aims at developing an elevator car without machine room so as to allow more effective space utilization in the building and in the elevator shaft than before. This means that the elevator must be capable of being installed in a fairly narrow elevator shaft if necessary. On the other hand, the invention aims at permitting the use of the elevator's own safety equipment even during elevator installation and maintenance work without a need to add any separate additional safety devices or separate locking devices to the elevator car. A further aim is to increase and ensure the safety of an elevator.

The elevator, system for locking an elevator car in place, and method for locking an elevator car in place are discussed in detail below. Other embodiments of the invention are also discussed in detail below. The inventive content of the present application can also be defined in other ways than is done in the claims below. The inventive content may also consist of several separate inventions, especially if the invention is considered in the light of explicit or implicit sub-tasks or in view of advantages or sets of advantages achieved. In this case, some of the attributes contained in the claims below may be superfluous in respect of separate inventive concepts.

By applying the invention, one or more of the following advantages, among others, can be achieved:

- the locking device locking the elevator in place by means of at least one safety gear can be easily used both during installation work and later during maintenance work

- the locking of the elevator car in place is easy and cheap to implement
- the locking mechanism is simple as the locking of the elevator car in place is implemented using a safety gear provided in conjunction with the elevator car, so there is no need for any separate additional locking devices
- the invention enables the locking mechanism to be used all the time during the operation of the elevator without having to make any-separate installations e.g. for the time of maintenance and/or installation work
- the locking mechanism of the invention can also be implemented in a manner permitting the inclusion of a separate locking element for use during maintenance and/or installation work, which element preferably comprises a pedal for the transmission of a force to release the safety gear/safety gears and which can be taken along after maintenance work
- the locking element, preferably a pedal, included in the locking mechanism is easy to carry along and it is light in construction
- the locking mechanism provided with a separate locking element can not be used incorrectly because, as pressing the pedal does not actuate the safety gear locking linkage to keep the safety gear released, the safety gear stops the elevator automatically
- the separate locking element can be quickly and easily installed in position in the elevator for the time of maintenance and/or installation work or in other situations where installation/maintenance personnel have to get onto the top of the elevator car.

In the elevator of the invention, which preferably is an elevator without counterweight, wherein the elevator car is suspended by hoisting ropes consisting of a single rope or a plurality of parallel ropes, and which elevator comprises a traction sheave which moves the elevator car by means of the hoisting ropes. The elevator has rope portions of the hoisting ropes going upwards and downwards from the elevator car. In addition, the elevator has at least one safety gear fitted in conjunction with the elevator car and engaging a guide rail. The elevator car of the invention is provided with a locking mechanism fitted in conjunction with the elevator car for locking the elevator car in place, said mechanism comprising means for activating and releasing at least one safety gear fitted on the elevator car.

The method of the invention relates to locking the elevator car in place in an elevator. The elevator car is at least partially supported by hoisting ropes, said hoisting ropes comprising a single rope or a plurality of parallel ropes. The elevator has a traction sheave which moves the elevator car by means of the hoisting ropes, and the hoisting ropes of the elevator comprise rope portions going upwards and downwards from the elevator car. In addition, the elevator is provided with at least one safety gear fitted in conjunction with the elevator car and engaging a guide rail. In the method of the invention, at least one safety gear fitted in conjunction with the elevator car is activated and released by means of a locking device fitted in conjunction with the elevator car.

By increasing the contact angle by means of a rope pulley functioning as a diverting pulley, the grip between the traction sheave and the hoisting ropes can be improved. This allows the car to be made lighter as well as smaller, thus increasing the space saving potential of the elevator. A contact angle of over 180° between the traction sheave and the hoisting rope is achieved by utilizing a diverting pulley or diverting pulleys. The need to compensate the rope elongation is due to the friction requirements to ensure a grip between the hoisting rope and the traction sheave that is sufficient in respect of operation and safety of the elevator. On the other hand, it is essential to elevator operation and safety that the rope portion below the elevator car in an elevator solution without counterweight be kept sufficiently tight. This can not necessarily be achieved by using a spring or a simple lever.

Figure 2:
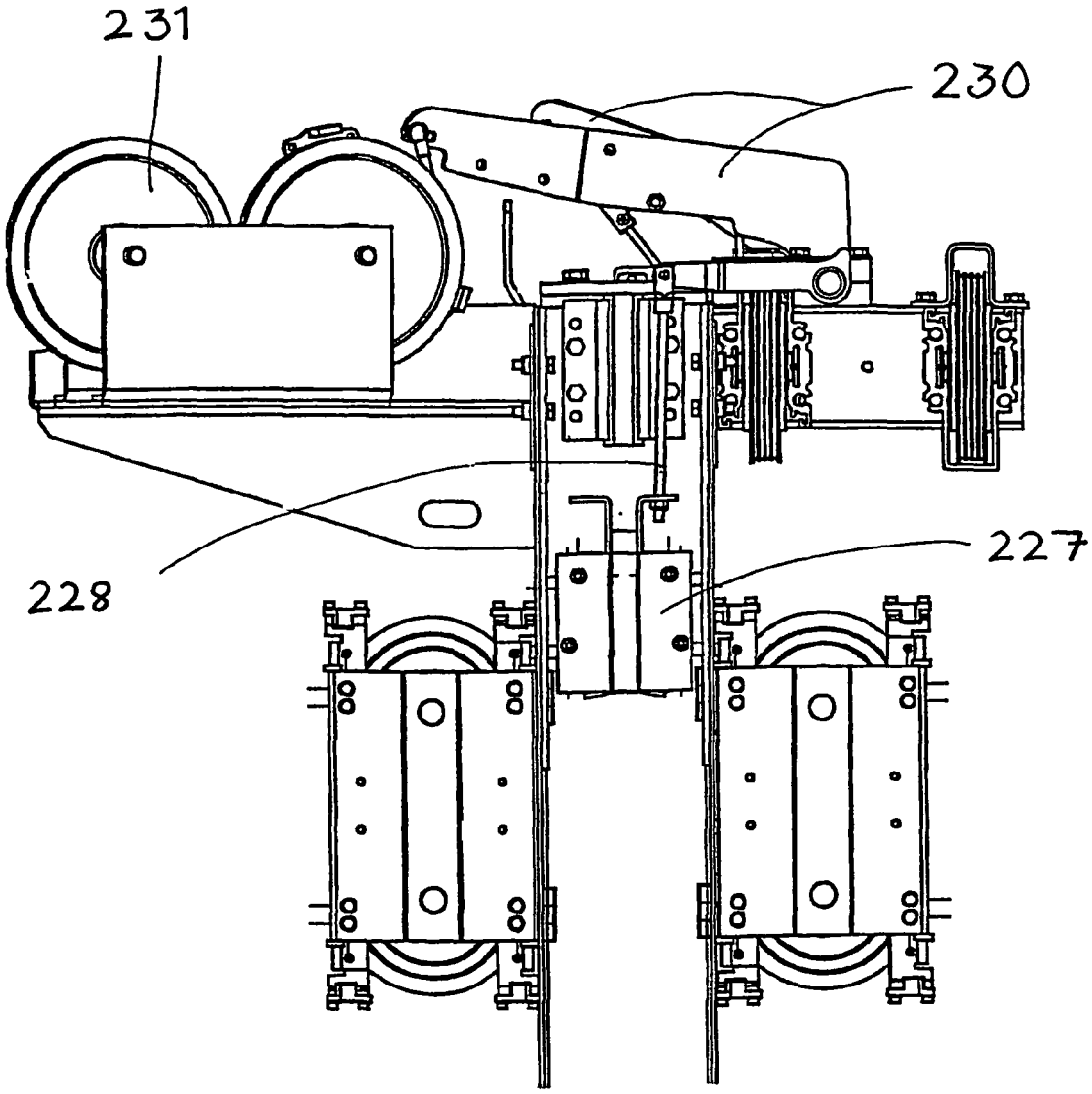
Figure 3:
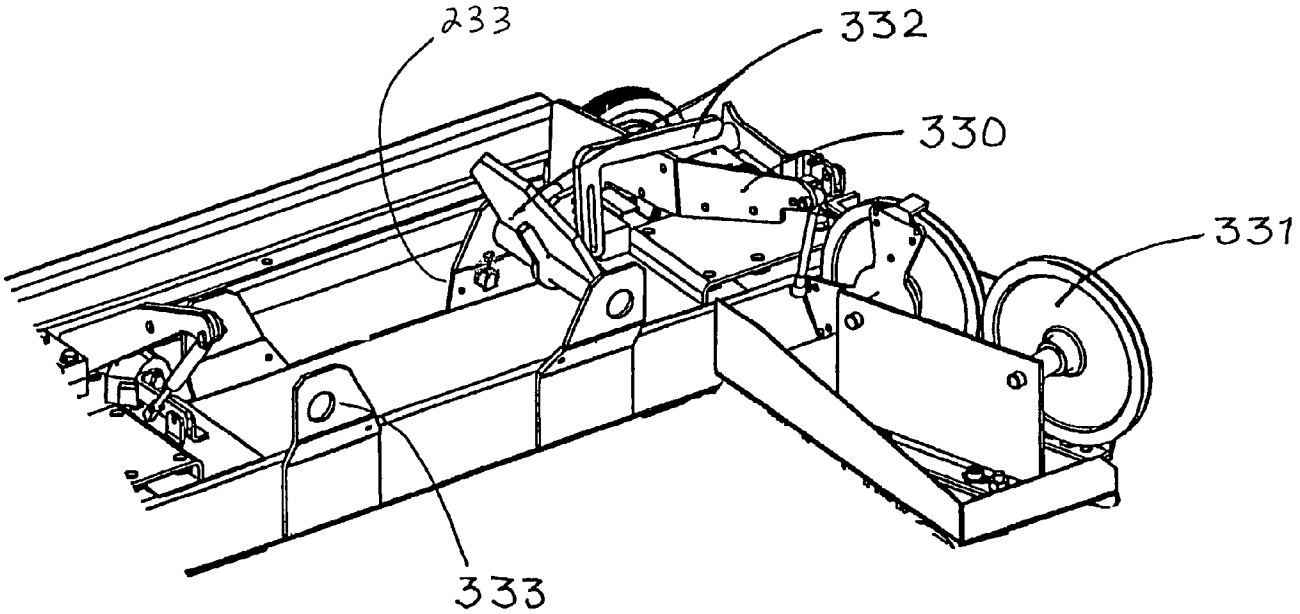

In the following, the invention will be described in detail with reference to a few embodiment examples and the attached drawings, wherein FIG. 1 presents a diagram representing a traction sheave elevator without counterweight and a locking mechanism according to the invention, FIG. 2 presents a diagrammatic illustration of an elevator according to the invention and its locking mechanism, which locking mechanism has been fitted to the car frame of the elevator, and FIG. 3 presents a locking mechanism according to the invention.

FIG. 1 presents an elevator without counterweight according to the invention, in which elevator a roping arrangement with a 2:1 suspension ratio is used in the portions of the hoisting ropes 3 above and below the elevator car 1 and DW roping is used between the traction sheave 5 and the diverting pulley 6. Compensation of rope elongations and constant rope forces are implemented using a rope elongation compensating device as presented in FIG. 1, which produces a rope force ratio of $T_1/T_2=2/1$. In the elevator it is also possible to use a different type of hoisting rope compensator, such as e.g. a lever or a tensioning wheel set or some other compensating device applicable for the purpose. In FIG. 1, the hoisting ropes run as follows. One end of the hoisting ropes is secured to a diverting pulley 25 fitted to hang on the rope portion coming downwards from diverting pulley 14. Diverting pulleys 14 and 25 together with the anchorage 26 of the second end of the hoisting rope form a rope force compensating system, which in the case of FIG. 1 is a compensating sheave system. This compensating device is fitted in place in the elevator shaft. From diverting pulley 25, the hoisting ropes 3 go upwards and meet diverting pulley 14, which is mounted above the elevator car in the elevator shaft, preferably in the upper part of the elevator shaft, passing around it along rope grooves provided in the diverting pulley 14. These rope grooves may be coated or uncoated, the coating consisting of e.g. a friction increasing material, such as polyurethane or some other appropriate material. From diverting pulley 14, the ropes go further downwards to a diverting pulley 9 fitted in place on the elevator car, and having passed around this pulley, the ropes 3 go further upwards in tangential contact with diverting pulley 6 to the traction sheave 5. Diverting pulley is preferably fitted in the vicinity and/or in conjunction with the hoisting machine 4. Between diverting pulley 6 and the traction sheave 5 of the hoisting machine 4, the figure shows DW (Double Wrap) roping, in which roping the hoisting ropes 3 run in tangential contact with diverting pulley 6 upwards to the traction sheave 5, and having passed around the traction sheave 5 the hoisting ropes return to diverting pulley 6, pass around it and return back to the traction sheave 5. In Double Wrap roping, when diverting pulley 6 is substantially of the same size with the traction sheave 5, the diverting pulley 6 can also function as a damping wheel. In this case, the ropes going from the traction sheave 5 to the elevator car 1 run via the rope grooves of diverting pulley 6, and the rope deflection caused by the diverting pulley is very small. It could be said that the ropes going from the traction sheave 5 to the elevator car only run in "tangential contact" with the diverting pulley 6. Such "tangential contact" serves as a solution damping the vibrations of the outgoing ropes and it can be applied in other roping solutions as well. An example of other roping solutions is Single Wrap (SW) roping where the diverting pulley is substantially of the same size with the traction sheave of the hoisting machine and the use of a diverting pulley is applied as a "tangential contact wheel" as described above. In SW roping according to the example, the ropes are passed around the traction sheave only once, the contact angle between the rope and the traction sheave being about 180°, the diverting pulley is utilized only for "tangential contact" of the rope as described above, the diverting pulley functioning as a rope guide and as a damping wheel for damping rope vibrations. Diverting pulleys 14, 9, 6 together with the hoisting machine 4 form the suspension arrangement above the elevator car, where the suspension ratio is the same as in the suspension arrangement below the elevator car, this suspension ratio being 2:1 in FIG. 1. From the traction sheave 5, the ropes run further in tangential contact with diverting pulley 6 to diverting pulley 8, which is preferably fitted in place in the lower part of the elevator shaft. Having passed around diverting pulley 8, the ropes 3 go further upwards to a diverting pulley 18 fitted in place on the elevator car, pass around this pulley and then go further downwards to a diverting pulley 23 in the lower part of the elevator shaft, and having passed around it the ropes go further upwards and return the diverting pulley 25 comprised in the compensating device. Having passed around this pulley, the hoisting ropes go further upwards to the anchorage 26 of their second end disposed in a suitable place in the elevator shaft. Diverting pulleys 8, 18, 23 form the hoisting rope suspension arrangement and the rope portion below the elevator car. The elevator hoisting machine 4 and the traction sheave 5 and/or the diverting pulleys 6, 14 disposed in the upper part of the elevator shaft may be mounted in place on the frame structure formed by the guide rails 2 or on a beam structure at the upper end of the elevator shaft or they may be secured separately in the elevator shaft or in some other appropriate mounting arrangement. The diverting pulleys in the lower part of the elevator shaft may be mounted in place on the frame structure formed by the guide rails 2 or on a beam structure located in the lower part of the elevator shaft or on some other appropriate mounting arrangement. The diverting pulleys on the elevator car may be mounted in place on the frame structure of the elevator car 1 or on a beam structure or beam structures comprised in the elevator car or they may be mounted separately on the elevator car or some other appropriate mounting arrangement. In FIG. 1, the elevator is provided with at least one, preferably two or more safety gears 27 fitted in conjunction with the elevator car, which safety gears can be activated and released by means of a locking mechanism 28. By operating the actuating element 30 of the locking mechanism 28, the safety gear 27 can be released, allowing the elevator to be moved and operated e.g. in maintenance mode. In this case, however, the locking mechanism 28 of the elevator is in its service position, in which position the safety gear 27 is in an activated state when the actuating element 30 is not acted on. When the locking mechanism of the elevator is in a normal position, the elevator safety gear 27 is in a released state and the elevator works in the normal way.

FIG. 2 presents a locking mechanism according to the invention arranged in conjunction with the car frame of an elevator car, by means of which mechanism the elevator car can be locked in place, e.g., during installation and/or maintenance work. In FIG. 2, the safety gear 227 is fitted to the car frame so that it will engage the elevator guide rails so as to lock the elevator car in place on the elevator guide rails. The elevator car may have more than one safety gear, preferably two or more safety gears fitted on it, each one of which can be actuated by means of the locking mechanism of the invention.

The mechanism presented in FIG. 2 is in the position of normal elevator operation or normal mode, in which position the safety gear is activated by means of an overspeed governor 231, normally in a situation where a predetermined speed of the overspeed governor 231 is exceeded. The overspeed governor activates the safety gear by means of a linkage 228 according to prior art. From the normal position of the locking mechanism, the linkage 228 activates the safety gear 227 immediately when the locking mechanism is turned to the service position. To release the safety gear 227 using an actuating element 230 (of which there may be more than one and they may be located anywhere on the elevator car, yet preferably on the top of the elevator car or in some other location easily accessible to a person working on the top of the elevator car), the safety gear 227 is acted on via the linkage 228 so as to release the safety gear 227. It is then possible to drive and/or move the elevator car. The elevator locking mechanism may be provided with a switching element 233 (shown in FIG. 3) for indicating the state of the locking mechanism. For example, the switching element 233 or elements 233 may indicate when the locking mechanism is in the service position, thus informing the elevator system about the state of the mechanism, and in this situation, e.g., only operation in maintenance mode is possible. The locking mechanism may also comprise a so-called "dead man's switch", which is used for monitoring to ensure that when the actuating element 230 of the locking mechanism is released, the safety gear 227 is activated, i.e., grips the guide rail immediately. This arrangement can be easily implemented by using, e.g., a gas spring or some other arrangement applicable for the purpose, in which arrangement the safety gear 227 is caused to be activated immediately after the user action on the actuating element 230 of the locking mechanism ceases while the elevator locking mechanism is in the service position. An elevator without counterweight may start moving in an uncontrolled manner only downwards during, e.g., installation, maintenance or normal operation because it has no counterweight. In the elevator of the invention, it is possible to use as safety devices during installation and maintenance work only the safety gears 227 which can be activated and released by means of the locking mechanism. In addition, the safety gears 227 used may be of a type functioning in one direction only, in other words, in the case of an elevator without counterweight, preventing escape in the downward direction only.

FIG. 3 presents a locking mechanism according to the invention which can be included as a part of the elevator if necessary. For example, a serviceman can add the locking mechanism to an elevator when he has to work on the top of the elevator car. FIG. 3 presents a detachable locking element 332 that can be taken along (it also shows overspeed governor 331). In the arrangement illustrated in FIG. 3, the locking element 332 is preferably a pedal which is fitted in place on the elevator car or the frame of the elevator car, on brackets 333 provided for it, and added as a part of the safety gear locking linkage 330. FIG. 3 also shows an example embodiment of switching element 233, discussed above. When the pedal is pressed down, e.g. by foot, the elevator safety gears will be released in the manner described in connection with FIGS. 1 and 2, whereupon it is possible to move the elevator car, e.g., when the elevator is to be operated in maintenance mode. The pedal also functions as a so-called dead man's switch, which means that when the resistance to the pedal disappears, the safety gears will be activated, i.e., they will grip, preferably the guide rails of the elevator car. The locking element 332 together with its actuator can be advantageously placed on either side of the elevator car and the locking linkage 330, in which case the elevator car or the car frame of the elevator car may be provided with at least two mounting points and/or mounting brackets or other equipment on which and by means of which the locking element 332 is secured in place. A serviceman can easily carry the locking element 332 along due to its light construction. In addition, the locking element 332 can be easily and quickly mounted in place as a part of an elevator, and the locking element 332 is cheap. In respect of operation, the locking element 332 is simple to mount in place, and its practically impossible to use it incorrectly because, when the locking element 332 is not pressing the locking linkage 330 downwards, the equipment provided in the safety gear, preferably a gas spring or equivalent, activates the safety gear into the activated state and the elevator is stopped.

A preferred embodiment of the elevator of the invention is an elevator without machine room with machine above and with a drive machine provided with a coated traction sheave, said elevator having thin and hard hoisting ropes of substantially round cross-section. In the elevator, the hoisting ropes have a contact angle exceeding 180° on the traction sheave and are implemented as DW roping in the hoisting machine, which hoisting machine comprises a traction sheave and a diverting pulley, and which machine comes with the traction sheave and diverting pulley ready fitted at a correct angle relative to each other. The hoisting machine is secured to the elevator guide rails. The elevator is implemented without counterweight with a suspension ratio of 8:1 in such manner that both the suspension ratio in the roping above the elevator car and the suspension ratio in the roping below the elevator car is 8:1, and that the elevator roping runs in the space between one of the walls of the elevator car and a wall of the elevator shaft. The elevator is provided with a compensating device which maintains the ratio between the forces $T_1/T_2$ as a constant ratio of 2:1. With the compensating device used, the required compensating distance is half the magnitude of the rope elongation. The elevator has a locking mechanism for locking the elevator car in place on the guide rails.

A second preferred embodiment of the elevator of the invention is an elevator without counterweight wherein the suspension ratio above and below the elevator car is 10:1. In this embodiment, conventional elevator ropes, preferably of a diameter of 8 mm, and a traction sheave made of cast iron at least in the rope groove area are used. The traction sheave has undercut rope grooves and the contact on the traction sheave has been fitted by means of a diverting pulley to be 180° or more. When conventional 8-mm ropes are used, the traction sheave diameter is preferably 340 mm. The diverting pulleys used are large rope wheels which, when a conventional 8-mm hoisting rope is used, have a diameter of 320, 330, 340 mm or even more.

It is obvious to the person skilled in the art that different embodiments of the invention are not limited to the examples described above, but that they may be varied within the scope of the claims presented below. For instance, the number of times the hoisting ropes are passed between the upper part of the elevator shaft and the elevator car and between the elevator car and the diverting pulleys below it is not a very decisive question as regards the basic advantages of the invention, although it is possible to achieve some additional advantages by using multiple rope passages. In general, applications are so implemented that the ropes go to the elevator car from above as many times as from below, so that the suspension ratios in the suspension arrangements above and below the elevator car are the same. It is obvious to the skilled person that the linkage and/or actuating equipment of the locking mechanism can be implemented in other ways than those presented in the examples, e.g. by using various wire rope arrangements.

It is obvious to the skilled person that the elevator of the invention can be implemented using almost any type of flexible hoisting means as hoisting ropes, e.g. flexible rope of one or more strands, flat belt, cogged belt, trapezoidal belt or some other type of belt applicable to the purpose. It is further obvious to the skilled person that the hoisting machine used in the elevator may be any type of elevator hoisting machine applicable for the purpose.

It is also obvious to the skilled person that, in the elevator of the invention, the elevator can also be provided with a counterweight, in which elevator for example the counterweight preferably has a weight below the weight of the car and is suspended by separate ropes.

The invention claimed is:

1. An elevator, comprising:
an elevator car having a car frame;
one or more hoisting ropes;
a traction sheave;
an overspeed governor;
at least one safety gear;
a locking mechanism;
guide rails; and
a compensating device;
wherein the elevator car is suspended by the one or more hoisting ropes,
wherein the one or more hoisting ropes includes first, second, third, and fourth rope portions,
wherein the traction sheave moves the elevator car using the one or more hoisting ropes,
wherein the compensating device acts in substantially opposite directions on the first and second rope portions in order to compensate rope elongations,
wherein the elevator car includes one or more first diverting pulleys from which the third rope portions extend upward from both sides of the one or more first diverting pulleys,
wherein the elevator car includes one or more second diverting pulleys from which the fourth rope portions extend downward from both sides of the one or more second diverting pulleys,
wherein the at least one safety gear is fitted in conjunction with the elevator car,
wherein the locking mechanism is fitted in conjunction with the elevator car,
wherein the overspeed governor is configured to activate, via a first linkage, the at least one safety gear during operation of the elevator,
wherein the locking mechanism is configured to activate and release, by operatively acting on the first linkage, the at least one safety gear during installation, maintenance, or installation and maintenance of the elevator,
wherein when activated, the at least one safety gear engages one of the guide rails in order to lock the elevator car in place,
wherein the overspeed governor, the at least one safety gear, and the locking mechanism are mounted to the car frame,
wherein the locking mechanism includes a detachable locking element in the form of a safety pedal,
wherein the detachable locking element is removably installed to the car frame, when the elevator is to be operated in maintenance mode, and
wherein the detachable locking element is portable and configured to activate and release the at least one safety gear via the first linkage.

2. The elevator of claim 1, wherein the locking mechanism has at least first and second positions,
wherein when the locking mechanism is in the first position, the at least one safety gear is released and the elevator is not locked in place, and
wherein when the locking mechanism is in the second position, the at least one safety gear is activated and the elevator is locked in place.

3. The elevator of claim 2, wherein if an operator causes the locking mechanism to be in the first position, the operator must continue to cause the locking mechanism to be in the first position or the locking mechanism will change to the second position.

4. The elevator of claim 2, wherein the locking mechanism includes an actuating element, and
wherein when the locking mechanism is in the first position, the at least one safety gear is adapted to be activated using the actuating element.

5. The elevator of claim 2, wherein the locking mechanism includes an actuating element, and
wherein when the locking mechanism is in the second position, the at least one safety gear is adapted to be released using the actuating element.

6. The elevator of claim 1, wherein the elevator is an elevator without counterweight.

7. The elevator of claim 1, wherein the elevator further comprises:
a switching element;
wherein the switching element is adapted to detect and indicate a position of the locking mechanism.

8. The elevator of claim 1, wherein the overspeed governor is further configured to release, via the first linkage, the at least one safety gear during operation of the elevator.

9. A system for locking an elevator car of an elevator in place, the system comprising:
at least one safety gear; and
a locking mechanism;
wherein the elevator includes:
the elevator car;
one or more hoisting ropes;
a traction sheave;
an overspeed governor;
guide rails; and
a compensating device;
wherein the elevator car has a car frame and is suspended by the one or more hoisting ropes,
wherein the one or more hoisting ropes includes first, second, third, and fourth rope portions,
wherein the traction sheave moves the elevator car using the one or more hoisting ropes,
wherein the compensating device acts in substantially opposite directions on the first and second rope portions in order to compensate rope elongations,
wherein the elevator car includes one or more first diverting pulleys from which the third rope portions extend upward from both sides of the one or more first diverting pulleys,
wherein the elevator car includes one or more second diverting pulleys from which the fourth rope portions extend downward from both sides of the one or more second diverting pulleys,
wherein the at least one safety gear is fitted in conjunction with the elevator car, wherein the locking mechanism is fitted in conjunction with the elevator car, wherein the overspeed governor is configured to activate, via a first linkage, the at least one safety gear during operation of the elevator, wherein the locking mechanism is configured to activate and release, by operatively acting on the first linkage, the at least one safety gear during installation, maintenance, or installation and maintenance of the elevator, wherein when activated, the at least one safety gear engages one of the guide rails in order to lock the elevator car in place wherein the overspeed governor, the at least one safety gear, and the locking mechanism are mounted to the car frame, wherein the locking mechanism includes a detachable locking element in the form of a safety pedal, wherein the detachable locking element is removably installed to the car frame, when the elevator is to be operated in maintenance mode, and wherein the detachable locking element is portable and configured to activate and release the at least one safety gear via the first linkage.

10. The system of claim 9, wherein the locking mechanism has at least first and second positions, wherein when the locking mechanism is in the first position, the at least one safety gear is released and the elevator is not locked in place, and wherein when the locking mechanism is in the second position, the at least one safety gear is activated and the elevator is locked in place.

11. The system of claim 10, wherein if an operator causes the locking mechanism to be in the first position, the operator must continue to cause the locking mechanism to be in the first position or the locking mechanism will change to the second position.

12. The system of claim 10, wherein the locking mechanism includes an actuating element, and wherein when the locking mechanism is in the first position, the at least one safety gear is adapted to be activated using the actuating element.

13. The system of claim 10, wherein the locking mechanism includes an actuating element, and wherein when the locking mechanism is in the second position, the at least one safety gear is adapted to be released using the actuating element.

14. The system of claim 9, wherein the elevator is an elevator without counterweight.

15. The system of claim 9, wherein the elevator further comprises:

a switching element;

wherein the switching element is adapted to detect and indicate a position of the locking mechanism.

16. The system of claim 9, wherein the overspeed governor is further configured to release, via the first linkage, the at least one safety gear during operation of the elevator.

17. A method for locking an elevator car of an elevator in place, the elevator including the elevator car, one or more hoisting ropes, a traction sheave, an overspeed governor, at least one safety gear, a locking mechanism, guide rails, and a compensating device, wherein the elevator car has a car frame and is suspended by the one or more hoisting ropes, wherein the one or more hoisting ropes includes first, second, third, and fourth rope portions, wherein the traction sheave moves the elevator car using the one or more hoisting ropes, wherein the compensating device acts in substantially opposite directions on the first and second rope portions in order to compensate rope elongations, wherein the elevator car includes one or more first diverting pulleys from which the third rope portions extend upward from both sides of the one or more first diverting pulleys, wherein the elevator car includes one or more second diverting pulleys from which the fourth rope portions extend downward from both sides of the one or more second diverting pulleys, wherein the at least one safety gear is fitted in conjunction with the elevator car, wherein the locking mechanism is fitted in conjunction with the elevator car, the method comprising:

using the overspeed governor to activate, via a linkage, the at least one safety gear during operation of the elevator;

using the locking mechanism to activate, by operatively acting on the linkage, the at least one safety gear during installation, maintenance, or installation and maintenance of the elevator; and engaging one of the guide rails with the at least one safety gear;

wherein the overspeed governor, the at least one safety gear, and the locking mechanism are mounted to the car frame, wherein the locking mechanism includes a detachable locking element in the form of a safety pedal, wherein the detachable locking element is removably installed to the car frame, when the elevator is to be operated in maintenance mode, and wherein the detachable locking element is portable and configured to activate and release the at least one safety gear via the first linkage.

* * * * *